US009852723B2

(12) United States Patent
Ely et al.

(10) Patent No.: US 9,852,723 B2
(45) Date of Patent: Dec. 26, 2017

(54) ACOUSTIC MODULES

(71) Applicant: Apple Inc., Cupertino, CA (US)

(72) Inventors: Colin M. Ely, Cupertino, CA (US); Fletcher R. Rothkopf, Los Altos, CA (US)

(73) Assignee: Apple Inc., Cupertino, CA (US)

( * ) Notice: Subject to any disclaimer, the term of this patent is extended or adjusted under 35 U.S.C. 154(b) by 729 days.

(21) Appl. No.: 14/227,115

(22) Filed: Mar. 27, 2014

(65) Prior Publication Data

US 2015/0273524 A1 Oct. 1, 2015

(51) Int. Cl.

| | |
|---|---|
| ***H04R 19/00*** | (2006.01) |
| ***G10K 9/22*** | (2006.01) |
| ***H04R 31/00*** | (2006.01) |

(52) U.S. Cl.

CPC ..... *G10K 9/22* (2013.01); *H04R 19/005* (2013.01); *H04R 31/00* (2013.01)

(58) Field of Classification Search

CPC ..... H04R 1/025; H04R 19/005; H04R 31/00; G10K 9/22

USPC ..... 381/335, 367; 367/355, 141; 310/311, 310/322, 367, 366, 320, 309; 29/428

See application file for complete search history.

(56) References Cited

U.S. PATENT DOCUMENTS

| | | | |
|---|---|---|---|
| 1,675,910 | A | 7/1928 | Riker |
| 2,859,510 | A | 11/1958 | Baxa |
| 2,909,281 | A | 10/1959 | Koskinen |
| 3,123,910 | A | 3/1964 | Neilson |
| 3,202,561 | A | 8/1965 | Swanson et al. |
| 4,038,783 | A | 8/1977 | Rosenthal |
| 4,111,029 | A | 9/1978 | Dulaquais |
| 4,164,704 | A | 8/1979 | Kato et al. |

(Continued)

FOREIGN PATENT DOCUMENTS

| | | |
|---|---|---|
| CN | 201248054 | 5/2009 |
| CN | 201940834 | 8/2011 |

(Continued)

OTHER PUBLICATIONS

Author Unknown, "Laboratory Instruments," http://www.mocon.com, 2 pages, at least as early as Oct. 12, 2012.

(Continued)

*Primary Examiner* — Thomas Dougherty
*Assistant Examiner* — Karen B Addison
(74) *Attorney, Agent, or Firm* — Kilpatrick Townsend & Stockton LLP

(57) ABSTRACT

In one embodiment, acoustic devices are formed on a substrate which is then placed on a first HAF layer, a screen, and a second HAF layer. The layers of HAF each have apertures aligned with acoustic ports of the devices. The substrate is heated such that the first layer of HAF adheres to the substrate and the screen and the second layer of HAF adheres to the screen. The substrate is cut to separate the devices into modules. In other embodiments, a waterproof membrane covering the acoustic port of an acoustic module may be bonded to a screen to form a gap such that it moves under pressure until restrained by the screen. In still other embodiments, back volume covers for acoustic devices are formed by stacking and heating a first HAF layer, a glass-reinforced epoxy laminate layer, a second HAF layer, and a top layer on a substrate.

11 Claims, 10 Drawing Sheets

(56) References Cited

U.S. PATENT DOCUMENTS

| | | | | |
|---|---|---|---|---|
| 4,232,928 | A | 11/1980 | Wickersham | |
| 4,584,799 | A | 4/1986 | Juvet | |
| 4,753,918 | A | 6/1988 | Cyron | |
| 4,911,796 | A | 3/1990 | Reed | |
| 5,028,075 | A | 7/1991 | Donnelly | |
| 5,217,335 | A | 6/1993 | Houchens, Jr. et al. | |
| 5,280,819 | A | 1/1994 | Newkirk et al. | |
| 5,779,218 | A | 7/1998 | Kowanz | |
| 5,843,117 | A | 12/1998 | Alt et al. | |
| 5,953,989 | A | 9/1999 | Uchiyama et al. | |
| 6,018,585 | A * | 1/2000 | Akino | H04R 1/086 381/189 |
| 6,149,506 | A | 11/2000 | Duescher | |
| 6,183,347 | B1 | 2/2001 | Shaw | |
| 6,188,773 | B1 * | 2/2001 | Murata | H04R 1/005 381/355 |
| 6,406,769 | B1 | 6/2002 | Delabre | |
| 6,453,783 | B2 | 9/2002 | Yu et al. | |
| 6,464,080 | B1 | 10/2002 | Morris et al. | |
| 6,517,995 | B1 | 2/2003 | Jacobson et al. | |
| 6,811,136 | B2 | 11/2004 | Eberhardt et al. | |
| 7,122,057 | B2 | 10/2006 | Beam et al. | |
| 7,171,838 | B2 | 2/2007 | Shiokawa | |
| 7,540,697 | B2 | 6/2009 | Wang et al. | |
| 7,582,175 | B2 | 9/2009 | Trejo-Rincon | |
| 7,597,483 | B2 | 10/2009 | Simmons et al. | |
| 7,685,676 | B2 | 3/2010 | McClellan | |
| 7,774,918 | B2 | 8/2010 | Ainsworth | |
| 8,015,852 | B2 | 9/2011 | Su | |
| 8,052,743 | B2 | 11/2011 | Weber et al. | |
| 8,066,251 | B2 | 11/2011 | Brown | |
| 8,252,379 | B2 | 8/2012 | Nagashima | |
| 8,564,961 | B2 | 10/2013 | Weber | |
| 8,597,078 | B2 | 12/2013 | Wilson et al. | |
| 8,994,608 | B2 | 3/2015 | Russell-Clarke et al. | |
| 9,510,091 | B2 * | 11/2016 | Katsuda | H04R 1/44 |
| 2005/0064345 | A1 | 3/2005 | Oyake | |
| 2006/0008616 | A1 | 1/2006 | Dean et al. | |
| 2006/0097127 | A1 | 5/2006 | Firth | |
| 2007/0039691 | A1 | 2/2007 | Mroz | |
| 2008/0206509 | A1 | 8/2008 | Kent et al. | |
| 2008/0257006 | A1 | 10/2008 | Durney et al. | |
| 2008/0312727 | A1 | 12/2008 | Blank | |
| 2009/0014118 | A1 | 1/2009 | Ratcliffe | |
| 2009/0043228 | A1 | 2/2009 | Northrop et al. | |
| 2011/0041553 | A1 | 2/2011 | Xiong et al. | |
| 2011/0156361 | A1 | 6/2011 | Ghalambor et al. | |
| 2011/0267773 | A1 | 11/2011 | MacFarlane | |
| 2013/0216740 | A1 | 8/2013 | Russell-Clarke et al. | |
| 2013/0251934 | A1 | 9/2013 | Caracciolo et al. | |
| 2013/0291367 | A1 | 11/2013 | Russell-Clarke et al. | |
| 2013/0318766 | A1 | 12/2013 | Kiple et al. | |
| 2014/0076731 | A1 | 3/2014 | Russell-Clarke et al. | |
| 2014/0082926 | A1 | 3/2014 | Tam et al. | |
| 2014/0102162 | A1 | 4/2014 | Morgenstern et al. | |
| 2015/0289395 | A1 | 10/2015 | Van Asseldonk et al. | |
| 2016/0089811 | A1 | 3/2016 | Matsuyuki et al. | |
| 2016/0090326 | A1 | 3/2016 | Matsuyuki et al. | |

FOREIGN PATENT DOCUMENTS

| | | |
|---|---|---|
| CN | 102316179 | 1/2012 |
| CN | 202872871 | 4/2013 |
| CN | 103873619 | 6/2014 |
| CN | 103951420 | 7/2014 |
| JP | 60244493 | 12/1985 |
| JP | 200061745 | 2/2000 |
| KR | 1020080103031 | 11/2008 |
| WO | WO03/002289 | 1/2003 |
| WO | WO2012/007755 | 1/2012 |
| WO | WO2013/093822 | 6/2013 |

OTHER PUBLICATIONS

Author Unknown, "Stewmac Inlay Tools and Materials," http://web.archirve.org/...op/Inlay,_pearl/Tools_and_supplies_for:_Inlay,_pearl_cutting/Carbide_Downcut_Inlay_Router_Bits.html, 5 pages, at least as early as Dec. 4, 2013.

* cited by examiner

ACOUSTIC MODULES

TECHNICAL FIELD

This disclosure relates generally to acoustic modules, and more specifically to acoustic modules integrating acoustic mesh and/or wafer manufactured back volume covers.

BACKGROUND

Many acoustic modules, such as microphone modules or speaker modules, are constructed by forming a plurality of acoustic devices on a substrate which are then die cut to form individual modules. Such individual modules are then typically coupled to a housing with a screen element sandwiched in between (covering an acoustic port of the acoustic module in order to block dust and other solid particles) using pressure sensitive adhesive. However, the pressure necessary to cure such pressure sensitive adhesive typically necessitates the use of a compression boot and a bracket in order to prevent error and/or slippage during the curing. Such assembly may be expensive, may be complex, and may require many parts.

Additionally, some acoustic modules may include a waterproof membrane that covers the acoustic port of such modules. Such a waterproof membrane may be permeable to air but not to water and may vibrate such that sound waves are able to enter and/or leave the acoustic module. However, hydrostatic pressure of such a waterproof membrane may stretch the waterproof membrane excessively to the point that the waterproof membrane tears under the hydrostatic pressure.

Furthermore, acoustic devices formed in a plurality on a substrate may utilize can elements to form the back volume of such acoustic devices. These can elements may be individually stamped out of metal and/or other materials and may then be separately fixed to the substrate before die cutting. However, such a process of individual stamping and later coupling to substrate may be burdensome and inefficient.

SUMMARY

The present disclosure details acoustic modules, such as speaker or microphone modules, and methods for manufacturing acoustic modules. In various embodiments, a plurality of acoustic modules that each include an acoustic port may be formed on a substrate. The substrate may be placed on a first layer of heat activated film (such as thermoplastic, thermoset, or other heat activated film) (or "HAF"), a screen layer (such as a mesh, heat resistant acoustic mesh, or other screen element), and a second layer of HAF. The first and second layers of HAF may each have a plurality of apertures that are aligned with the acoustic ports of the acoustic devices. The substrate, layers of HAF, and the screen layer may be heated (which may also include compressing the layers) such that the first layer of HAF adheres to the substrate and the screen layer and the second layer of HAF adheres to the screen layer. The substrate may be cut to separate the plurality of acoustic devices into acoustic device modules.

In some cases of such embodiments, individual acoustic device modules may be placed on a housing and heated to cause the second layer of HAF to adhere to the housing. In such cases, the first heating may be performed at a first temperature that causes the second layer of HAF to partially cure and the second heating may be performed at a second temperature that causes the second layer of HAF to fully cure.

In various cases, the screen layer may be formed of stainless steel, a composite material, brass, aluminum, and/or similar material. Such a screen layer may be woven and/or may be formed by chemical etching or laser perforating a sheet of material to form a plurality of holes.

In one or more embodiments, an acoustic module may include at least one acoustic port. A screen element may be bonded to a surface of the acoustic device to cover the acoustic port. A waterproof (i.e. waterproof and/or water resistant) membrane may be bonded to the at screen element. The waterproof membrane may be bonded to the screen element such that a gap is formed between the screen element and the waterproof membrane over the acoustic port such that the waterproof membrane is able to move through the gap under pressure until restrained by the screen element.

In some cases of such embodiments, the waterproof membrane may be formed of polytetrafluoroethylene, expanded polytetrafluoroethylene, and/or similar materials.

In one or more embodiments, a plurality of acoustic device components may be placed on a substrate. A first layer of HAF, at least one glass-reinforced epoxy laminate layer, a second layer of HAF, and a top layer may be stacked on the substrate. The first layer of HAF, glass-reinforced epoxy laminate layer, and second layer of HAF may each have a plurality of apertures that accommodate the plurality of acoustic device components such that the first layer of HAF, glass-reinforced epoxy laminate layer, second layer of HAF, and top layer form back volumes for acoustic devices. The substrate, HAF layers, glass-reinforced epoxy laminate layer, and top layer may be heated such that the first layer of HAF adheres to the substrate and the glass-reinforced epoxy laminate layer and the second layer of HAF adheres to the glass-reinforced epoxy laminate layer and the top layer. The substrate may be cut to separate the plurality of acoustic devices into acoustic device modules.

In some cases of such embodiments, the glass-reinforced epoxy laminate or similar material layer and/or the top layer may be formed of EMF shielding material and/or the glass-reinforced epoxy laminate or similar material layer and/or the top layer may be coated with an EMF shielding coating.

In various implementations, a method for acoustic module manufacture includes: forming a plurality of acoustic devices on a substrate, each of the plurality of acoustic modules including at least one acoustic port; placing the substrate on at least one first layer of heat activated film, at least one screen layer, and at least one second layer of heat activated film wherein the at least one first layer of heat activated film and the at least one second layer of heat activated film each include a plurality of apertures aligned with acoustic ports of the plurality of acoustic device; heating the substrate, the at least one first layer of heat activated film, the at least one screen layer, and the at least one second layer of heat activated film such that the at least one first layer of heat activated film adheres to the substrate and the at least one screen layer and the at least one second layer of heat activated film adheres to the at least one screen layer; and cutting the substrate to separate the plurality of acoustic devices into acoustic device modules.

In some implementations, an acoustic module includes an acoustic device with at least one acoustic port; at least one screen element bonded to a surface of the at least one acoustic device to cover the at least one acoustic port; and at least one waterproof membrane bonded to the at least one screen element to cover the at least one acoustic port. At least one gap may be formed between the at least one screen element and the at least one waterproof membrane such that at least a portion of the at least one waterproof membrane is able to move through the gap under pressure until restrained by at least a portion of the at least one screen element.

In one or more implementations, a method for acoustic module manufacture includes: placing a plurality of acoustic devices on a substrate; stacking at least one first layer of heat activated film, at least one glass-reinforced epoxy laminate layer, at least one second layer of heat activated film, and a top layer on the substrate wherein the at least one first layer of heat activated film, the at least one glass-reinforced epoxy laminate layer, and the at least one second layer of heat activated film each include a plurality of apertures that accommodate the plurality of acoustic devices to form back volumes for the plurality of acoustic devices; heating the substrate, the at least one first layer of heat activated film, the at least one glass-reinforced epoxy laminate layer, the at least one second layer of heat activated film, and the top layer such that the at least one first layer of heat activated film adheres to the substrate and the at least one glass-reinforced epoxy laminate layer and the at least one second layer of heat activated film adheres to the at least one glass-reinforced epoxy laminate layer and the top layer; and cutting the substrate to separate the plurality of acoustic devices into acoustic device modules.

It is to be understood that both the foregoing general description and the following detailed description are for purposes of example and explanation and do not necessarily limit the present disclosure. The accompanying drawings, which are incorporated in and constitute a part of the specification, illustrate subject matter of the disclosure. Together, the descriptions and the drawings serve to explain the principles of the disclosure.

DETAILED DESCRIPTION

The description that follows includes sample systems, methods, and computer program products that embody various elements of the present disclosure. However, it should be understood that the described disclosure may be practiced in a variety of forms in addition to those described herein.

The present disclosure details acoustic modules, such as speaker or microphone modules, and methods for manufacturing acoustic modules. In various embodiments, a plurality of acoustic modules that each include an acoustic port may be formed on a substrate. The substrate may be placed on a first layer of heat activated film (such as thermoplastic, thermoset, or other heat activated film) (or "HAF"), a screen layer (such as a mesh, heat resistant acoustic mesh, or other screen element), and a second layer of HAF. The first and second layers of HAF may each have a plurality of apertures that are aligned with the acoustic ports of the acoustic devices. The substrate, layers of HAF, and the screen layer may be heated (which may also include compressing the layers) such that the first layer of HAF adheres to the substrate and the screen layer and the second layer of HAF adheres to the screen layer. The substrate may be cut to separate the plurality of acoustic devices into acoustic device modules.

In one or more embodiments, an acoustic module may include at least one acoustic port. A screen element may be bonded to a surface of the acoustic device to cover the acoustic port. A waterproof (i.e. waterproof and/or water resistant) membrane may be bonded to the at screen element. The waterproof membrane may be bonded to the screen element such that a gap is formed between the screen element and the waterproof membrane over the acoustic port such that the waterproof membrane is able to move through the gap under pressure until restrained by the screen element.

In one or more embodiments, a plurality of acoustic device components may be placed on a substrate. A first layer of HAF, at least one glass-reinforced epoxy laminate layer, a second layer of HAF, and a top layer may be stacked on the substrate. The first layer of HAF, glass-reinforced epoxy laminate layer, and second layer of HAF may each have a plurality of apertures that accommodate the plurality of acoustic device components such that the first layer of HAF, glass-reinforced epoxy laminate layer, second layer of HAF, and top layer form back volumes for acoustic devices. The substrate, HAF layers, glass-reinforced epoxy laminate layer, and top layer may be heated such that the first layer of HAF adheres to the substrate and the glass-reinforced epoxy laminate layer and the second layer of HAF adheres to the glass-reinforced epoxy laminate layer and the top layer. The substrate may be cut to separate the plurality of acoustic devices into acoustic device modules.

Figure 1A:
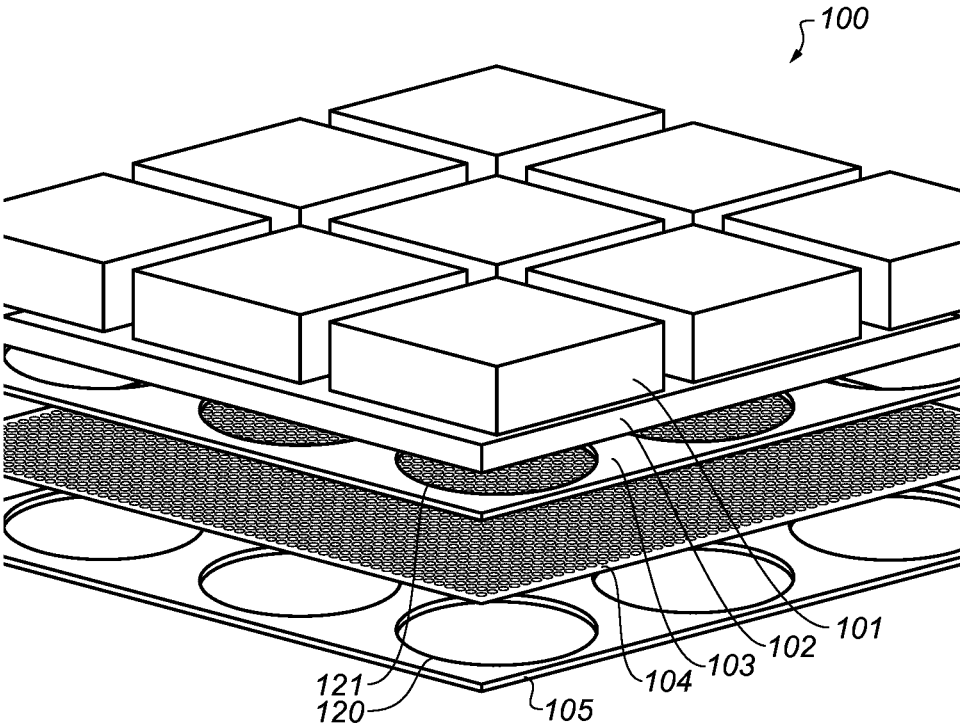
FIG. 1A is an isometric view of a first embodiment of assembly of a plurality of acoustic devices.

FIG. 1A is an isometric view of a first embodiment of assembly 100 of a plurality of acoustic devices 101, such as one or more microphones and/or speakers (such as one or more microelectromechanical systems, or "MEMS" microphones or speakers). As illustrated, a plurality of acoustic devices 101 may be formed on a substrate 102. The substrate may be placed on at least one first layer of HAF 103 (such as a layer of thermoplastic, thermoset, or other heat activated film), at least one screen layer 104 (such as a mesh, a heat resistant acoustic mesh, or other screen element), and a second layer of HAF 105. The first and second layers of HAF may have a plurality of apertures 120 and 121 that align with acoustic ports of the acoustic devices (See FIG. 1D).

In some cases, the screen layer 104 may be formed of stainless steel, a composite material or alloy, brass, aluminum, and/or other such material. The screen layer may include a plurality of holes. Such holes may be formed by weaving, chemical etching of a sheet of material, laser perforation of a sheet of material, and so on.

Figure 1B:
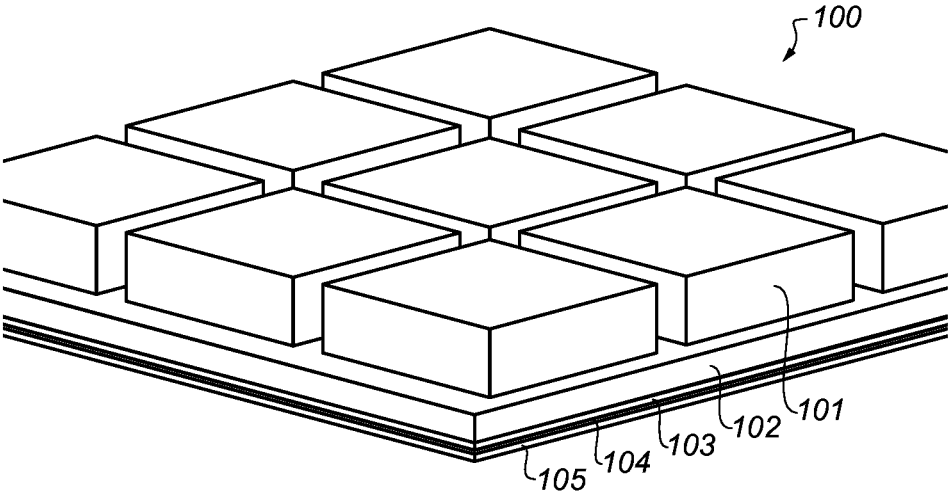
FIG. 1B illustrates the plurality of acoustic devices of FIG. 1A after assembly.

The substrate 102, layers of HAF 103 and 105, and the screen layer 104 may be heated. Such heating may cause the first layer of HAF to adhere to the substrate and the screen layer and/or the second layer of HAF to adhere to the screen layer, as shown in FIG. 1B. Such heating may also involve compressing the substrate, the layers of HAF, and/or the screen layer.

The substrate 102 may be cut to separate the plurality of acoustic devices 101 into acoustic device modules. Such cutting may be die cutting.

Figure 1C:
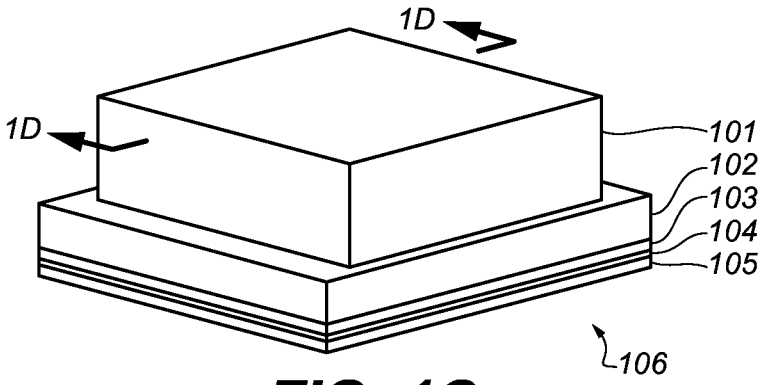
FIG. 1C illustrates one of the acoustic modules of FIG. 1B after die cutting the plurality of acoustic devices into individual modules.

FIG. 1C illustrates one such acoustic module 106 after cutting the plurality of acoustic devices 101 into individual modules.

Figure 1D:
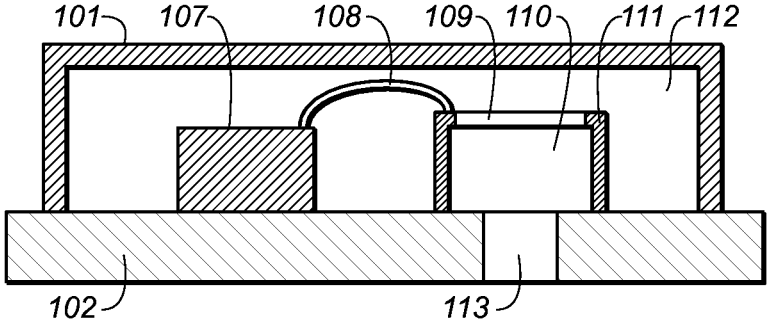
FIG. 1D is a cross-sectional view of the acoustic module of FIG. 1C taken along line 1D of FIG. 1C.

FIG. 1D is a cross-sectional view of the acoustic module 106 of FIG. 1C taken along line 1D of FIG. 1C. By way of example, the acoustic module is illustrated as a MEMS microphone module. However, this is for the purposes of example and the acoustic module may be any kind of acoustic module, such as a speaker module, without departing from the scope of the present disclosure.

As illustrated, the acoustic module includes a MEMS microphone component 111 with an acoustic membrane 109 and a front volume 110 positioned over an acoustic port 113. As further illustrated, the MEMS microphone component is connected to a controller 107 (which may be an application specific integrated circuit) via a connection mechanism 108 (such as a wire bond). The controller may detect vibration of the acoustic membrane caused by sound waves in order to detect sound. Though not shown, the substrate may include one or more vias and/or other connection elements such as contact pads on one or more surfaces for coupling one or more connection mechanisms to the controller.

Figure 1E:
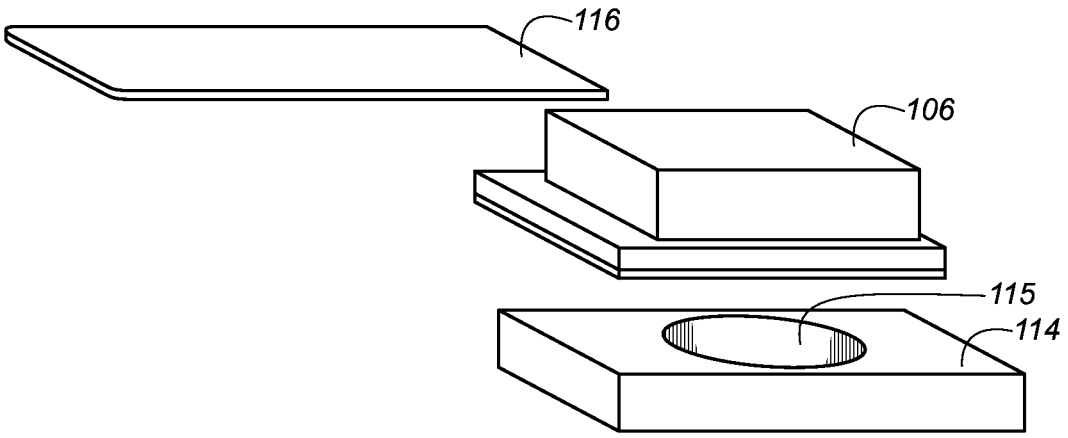
FIG. 1E is an isometric view of the acoustic module of FIG. 1C being coupled to a housing.

FIG. 1E is an isometric view of the acoustic module 106 of FIG. 1C being coupled to a housing 114 and a connection mechanism 116 (such as one or more surface mount attachment connection mechanisms, hot bar connection mechanisms, anisotropic conductive film connection mechanisms, flex circuit connection mechanisms, and/or other connection mechanisms). The housing may include an acoustic port 115 that aligns with the acoustic port 113 of the acoustic module.

Figure 1F:
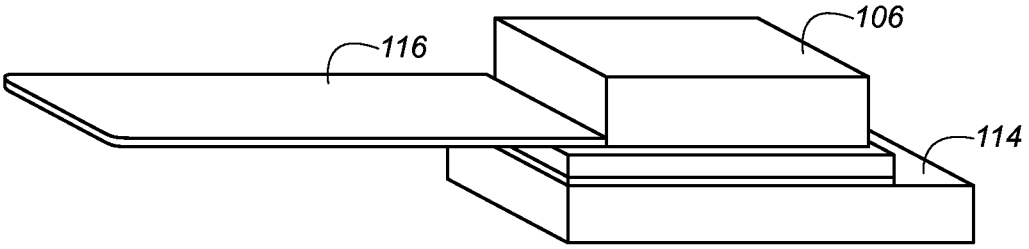
FIG. 1F illustrates the view of FIG. 1E after coupling.

The acoustic module 116 may be heated (which may include compression) to couple the acoustic module to the housing. FIG. 1F illustrates the view of FIG. 1E after coupling. Such heating may cause the second layer of HAF 105 to adhere to the housing 114. In some cases, the heating performed before cutting the plurality of acoustic devices 101 into individual modules may be performed at a first temperature (such as 180 C) that causes the second layer of HAF 105 to partially cure and the heating of the acoustic module and housing may be performed at a second temperature (such as 240 C) that causes the second layer of HAF 105 to fully cure.

As illustrated, the connection mechanism 116 may couple to a surface of the substrate. Such a surface may include one or more contact pads and/or similar mechanisms that electrically connect the connection mechanism to the controller 107. Although this example is shown as the substrate including such contact pads and/or similar mechanisms on a top surface of the substrate, it is understood that this is an example. In various implementations, such contact pads and/or similar mechanisms may be located on any surface of the substrate.

In this way, coupling of the screen element 104 may be part of wafer manufacture of a plurality of acoustic modules as opposed to later being coupled to separated individual acoustic modules.

Returning to FIG. 1E, although the acoustic module 116 is illustrated and described as adhering the second layer of HAF 105 to the housing 114, it is understood that this is an example. In one or more implementations, other components may be positioned between the second layer of HAF and the housing without departing from the scope of the present disclosure.

For example, in some implementations the second layer of HAF 105 may be coupled to a waterproof (i.e., waterproof or water resistant) membrane. The screen layer 104 may prevent dust or other solid particles from entering the acoustic module 106, but such a waterproof membrane (such as one formed from polytetrafluoroethylene, expanded polytetrafluoroethylene, and/or other such waterproof material) may be permeable to air but impermeable to water.

A gap may be formed between the waterproof membrane and the screen layer 104 (such as by the spacing resulting from the coupling of the waterproof membrane and the screen layer 104 by the second layer of HAF) such that the waterproof membrane is able vibrate in order to pass acoustic waves into and/or out of the acoustic module and/or move under hydrostatic pressure. However, the dimensions of the gap may be configured such that the screen layer 104 operates to restrain movement of the waterproof membrane when the waterproof membrane is subjected to sufficient hydrostatic pressure. Such restraint may prevent the waterproof membrane from being stretched far enough by the hydrostatic pressure that it tears. In such implementations, the screen layer 104 may be thick enough to not move under hydrostatic pressures that may otherwise tear the waterproof membrane.

In this way, a waterproof membrane that is resistant to hydrostatic pressure may be utilized with acoustic modules.

As shown in FIG. 1A, the acoustic devices 101 may include a back volume cover formed by individual cans. Such cans may be formed by individually stamping the cans from metal and/or other materials. However, it is understood that this is an example. In one or more implementations, other back volume covers for the acoustic devices may be utilized without departing from the scope of the present disclosure.

For example, the acoustic devices 101 may be formed by placing a plurality of acoustic components on the substrate 102. A third layer of HAF, at least one glass-reinforced epoxy or similar material layer, a fourth layer of HAF, and a top layer (such as a top layer formed of plastic, metal, glass-reinforced epoxy, and/or other material) may be stacked on the substrate. The third layer of HAF, one glass-reinforced epoxy or similar material layer, and fourth layer of HAF may each include a plurality of apertures that accommodate the plurality of acoustic device components to form back volumes for the acoustic devices. The substrate, third layer of HAF, glass-reinforced epoxy or similar material layer, fourth layer of HAF, and the top layer may be heated (which may include compressing the third layer of HAF, the glass-reinforced epoxy or similar material layer, and the fourth layer of HAF) such that the third layer of HAF adheres to the substrate and the glass-reinforced epoxy or similar material layer and the fourth layer of HAF adheres to the glass-reinforced epoxy or similar material layer and the top layer.

In this way, the back volume cover may be formed as part of wafer manufacture of a plurality of acoustic modules as opposed to individual stamping of can elements.

Figure 2:
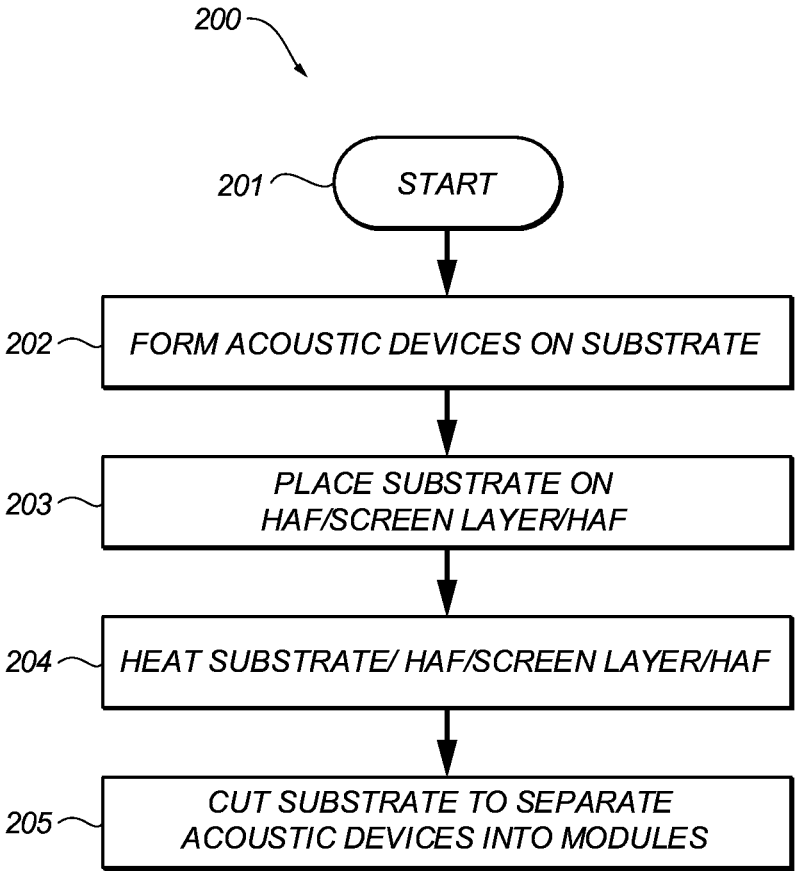
FIG. 2 is a method diagram illustrating a first example method for acoustic module manufacture. This method may involve operations and components similar to those illustrated in FIGS. 1A-1F.

FIG. 2 is a method diagram illustrating a first example method 200 for acoustic module manufacture. This method may involve operations and components similar to those illustrated in FIGS. 1A-1F.

The flow begins at block 201 and proceeds to block 202 where acoustic devices are formed on a substrate. The flow may then proceed to block 203 where the substrate is placed on a first layer of HAF, at least one screen layer, and a second layer of HAF. Next, the flow may proceed to block 204 where the substrate, first layer of HAF, screen layer, and second layer of HAF are heated. Such heating causes the first layer of HAF to adhere to the substrate and the screen layer and the second layer of HAF to adhere to the screen layer.

Finally, the flow may proceed to block 205 where the substrate is cut to separate the acoustic devices into individual acoustic modules. Such cutting may be die cutting of the substrate.

Although the method 200 is illustrated and described as including a particular set of operations performed in a particular order, it is understood that this is an example. In various implementations, various orders of the same, similar, and/or different operations may be performed without departing from the scope of the present disclosure.

For example, block 204 describes heating the substrate, first layer of HAF, screen layer, and second layer of HAF. However, in various implementations such a process may include both heating and compressing the substrate, first layer of HAF, screen layer, and second layer of HAF.

Figure 3A:
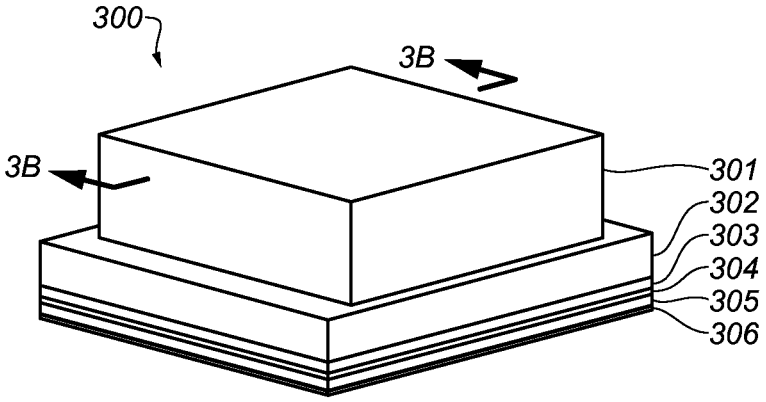
FIG. 3A is an isometric view of an embodiment of an waterproof acoustic module.

FIG. 3A is an isometric view of an embodiment of an waterproof acoustic module 300, which may be a speaker module, a microphone module, a MEMS speaker module, a MEMS microphone module, and/or other acoustic module. The acoustic module may include a back volume cover 301 and acoustic components (see components 308-312 in FIG. 3B) formed on a substrate 302. A screen layer 304 (such as a mesh, heat resistant acoustic mesh, or other screen element) may be coupled to the substrate to cover an acoustic port (see 313 in FIG. 3B) via an adhesive and/or other coupling element layer 303 (which may be HAF and/or other adhesive and/or coupling elements). The screen element may prevent entry of dust or other solid particles into the acoustic module.

The acoustic module 300 may also include a waterproof (i.e., waterproof and/or water resistant) membrane 306 (such as one formed from polytetrafluoroethylene, expanded polytetrafluoroethylene, and/or other such waterproof material) coupled to the screen layer 304 by an adhesive and/or other coupling element layer 305 (which may be HAF and/or other adhesive and/or coupling elements). The waterproof membrane be permeable to air but impermeable to water and may cover the acoustic port. The waterproof membrane may vibrate in order to pass acoustic waves into and/or out of the acoustic module 300 and/or move under hydrostatic pressure.

Figure 3B:
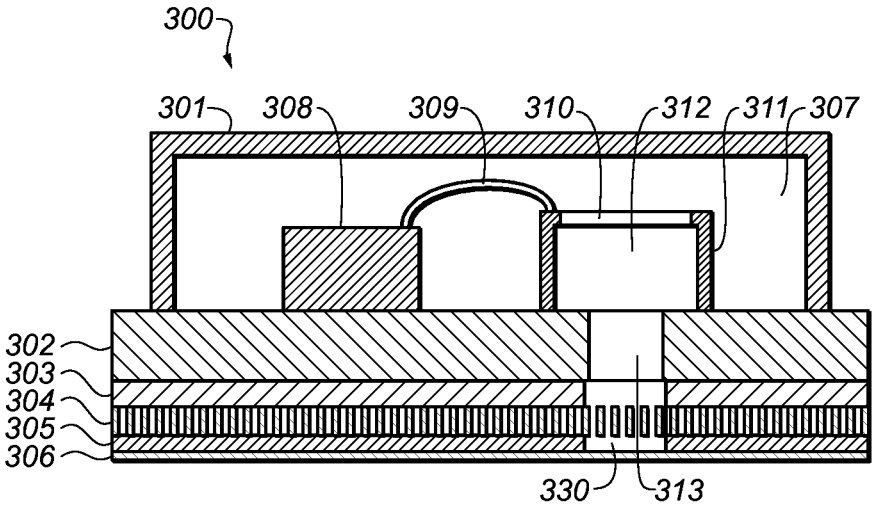
FIG. 3B is a cross-sectional view of the waterproof acoustic module of FIG. 3A taken along line 3B of FIG. 3A.

FIG. 3B is a cross-sectional view of the waterproof acoustic module 300 of FIG. 3A taken along line 3B of FIG. 3A. As illustrated, the acoustic module includes a MEMS microphone component 311 with an acoustic membrane 310 and a front volume 312 positioned over the acoustic port 313. As further illustrated, the MEMS microphone component is connected to a controller 308 (which may be an application specific integrated circuit) via a connection mechanism 309 (such as a wire bond). Though not shown, the substrate may include one or more vias and/or other connection elements such as contact pads on one or more surfaces for coupling one or more connection mechanisms to the controller.

Figure 3C:
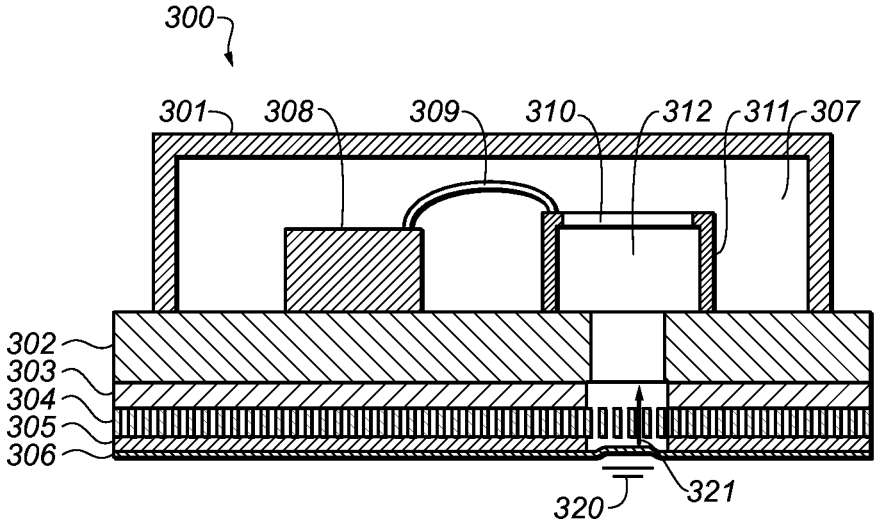
FIG. 3C illustrates vibration of the waterproof membrane of the waterproof acoustic module of FIG. 3B.

As also illustrated, a gap 330 may be formed between the waterproof membrane 306 and the screen layer 304 (such as by the spacing resulting from the adhesive and/or other coupling element layer 305). This may enable the waterproof membrane to vibrate in order to pass acoustic waves 320 and 321 into (as shown in FIG. 3C) and/or out of the acoustic module 300 and/or move under hydrostatic pressure.

Figure 3D:
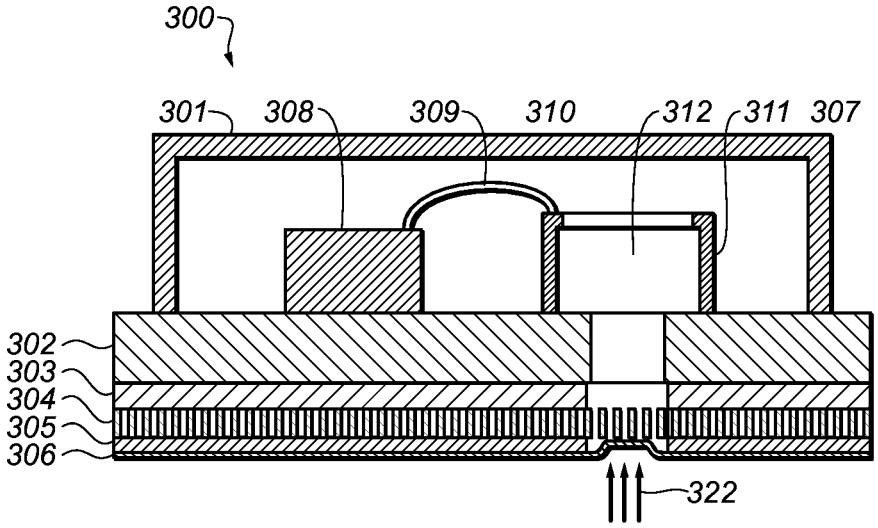
FIG. 3D illustrates hydrostatic pressure on the waterproof membrane of the waterproof acoustic module of FIG. 3B.

However, the dimensions of the gap may be configured such that the screen layer 304 operates to restrain movement of the waterproof membrane when the waterproof membrane is subjected to sufficient hydrostatic pressure 322 (as illustrated in FIG. 3D). Such restraint may prevent the waterproof membrane from being stretched far enough by the hydrostatic pressure that it tears. In such implementations, the screen layer 304 may be thick enough to not move under hydrostatic pressures that may otherwise tear the waterproof membrane.

In this way, a waterproof membrane 306 that is resistant to hydrostatic pressure may be utilized with acoustic modules 300.

In some cases, the screen layer 304 may be formed of stainless steel, a composite material or alloy, brass, aluminum, and/or other such material. The screen layer may include a plurality of holes. Such holes may be formed by weaving, chemical etching of a sheet of material, laser perforation of a sheet of material, and so on.

Figure 4:
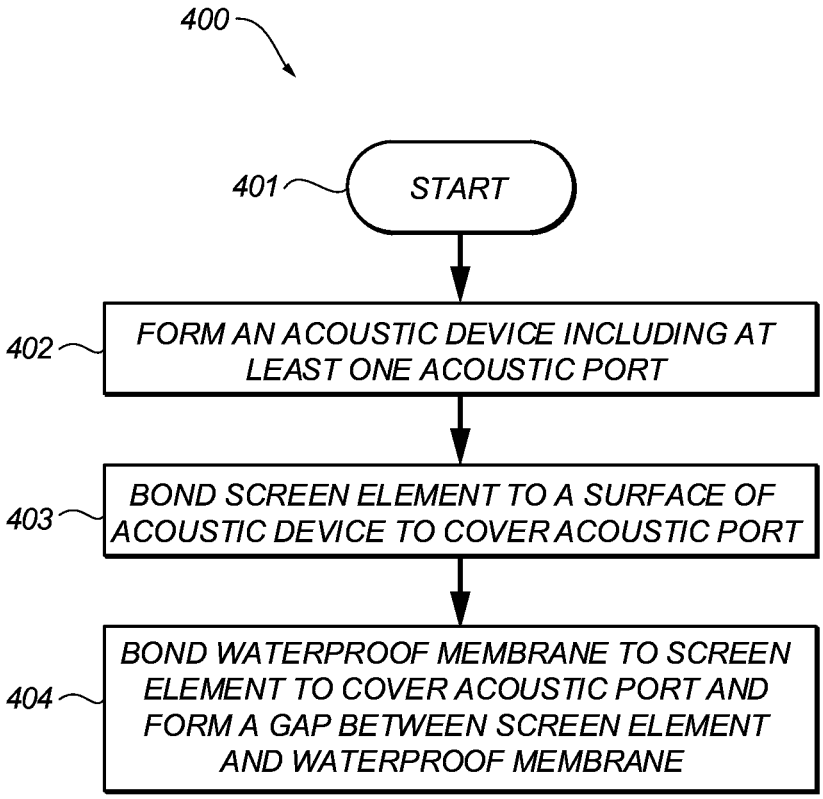
FIG. 4 is a method diagram illustrating an example method for waterproof acoustic module manufacture. This method may involve components similar to those illustrated in FIGS. 3A-3D.

FIG. 4 is a method diagram illustrating an example method 400 for waterproof acoustic module manufacture. This method may involve components similar to those illustrated in FIGS. 3A-3D.

The flow begins at block 401 and may then proceed to block 402 where an acoustic device is formed that includes at least one acoustic port. The flow may then proceed to block 403 where a screen element is bonded to a surface of the acoustic device to cover the acoustic port.

Next, the flow may then proceed to block 404 where a waterproof membrane is bonded to the screen element to cover the acoustic port. A gap may be formed between the waterproof membrane and the screen element such that the waterproof membrane is able to vibrate to pass sound in and/or out of the acoustic module but the screen element restrains the waterproof membrane when the waterproof membrane is subjected to hydrostatic pressure.

Although the method 400 is illustrated and described as including a particular set of operations performed in a particular order, it is understood that this is an example. In various implementations, various orders of the same, similar, and/or different operations may be performed without departing from the scope of the present disclosure.

For example, blocks 403 and 404 are illustrated as separate operations performed in a linear order. However, in various implementations these operations may be performed simultaneously.

Figure 5A:
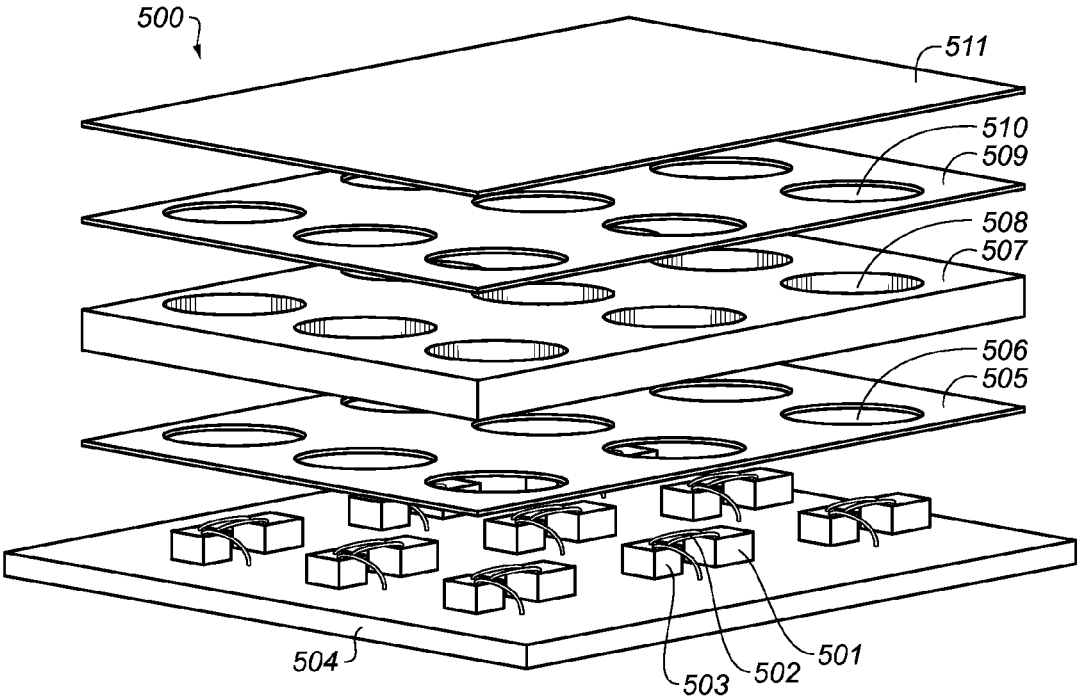
FIG. 5A is an isometric view of a second embodiment of assembly of a plurality of acoustic devices.

FIG. 5A is an isometric view of a second embodiment of assembly 500 of a plurality of acoustic devices. As illustrated, a plurality of acoustic components 501-503 may be formed on a substrate 504. The acoustic components may be components of speaker module, a microphone module, a MEMS speaker module, a MEMS microphone module, and/or other acoustic module.

As also illustrated, a first layer of HAF 505, at least one glass-reinforced epoxy or similar material layer 507, a fourth layer of HAF 509, and a top layer 511 (such as a top layer formed of plastic, metal, glass-reinforced epoxy, and/or other material) may be stacked on the substrate 502. The first layer of HAF, one glass-reinforced epoxy or similar material layer, and second layer of HAF may each include a plurality of apertures 506, 508, and 510 that accommodate the plurality of acoustic device components to form back volumes for the acoustic devices.

The substrate 504, first layer of HAF 505, glass-reinforced epoxy or similar material layer 507, second layer of HAF 509, and the top layer 511 may be heated (which may include compressing the second layer of HAF, the glass-reinforced epoxy or similar material layer, and the second layer of HAF) such that the first layer of HAF adheres to the substrate and the glass-reinforced epoxy or similar material layer and the second layer of HAF adheres to the glass-reinforced epoxy or similar material layer and the top layer.

Figure 5B:
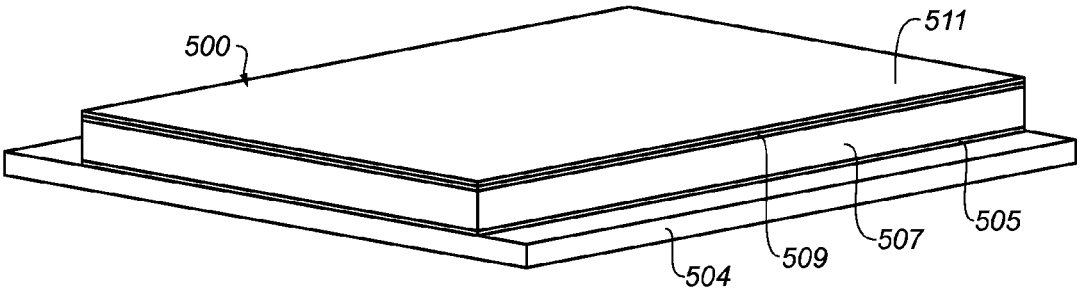
FIG. 5B illustrates the plurality of acoustic devices of FIG. 5A after assembly.
Figure 5C:
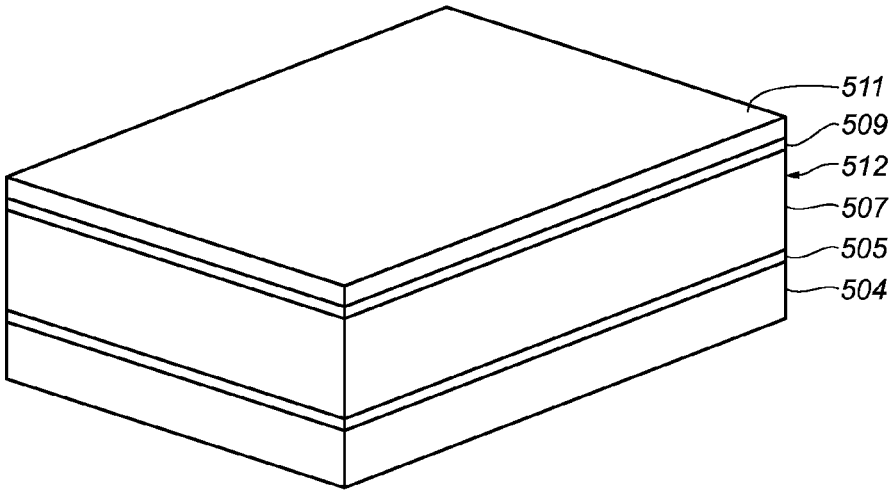
FIG. 5C illustrates one of the acoustic modules of FIG. 5B after die cutting the plurality of acoustic devices into individual modules.

FIG. 5B illustrates the plurality of acoustic devices of FIG. 5A after assembly 500. The substrate may be cut, such as by die cutting, to separate the plurality of acoustic devices into acoustic device modules. FIG. 5C illustrates one of the acoustic modules of FIG. 5B after die cutting the plurality of acoustic modules into individual modules.

In this way, the back volume cover may be formed as part of wafer manufacture of a plurality of acoustic modules as opposed to individual stamping of can elements.

Figure 5D:
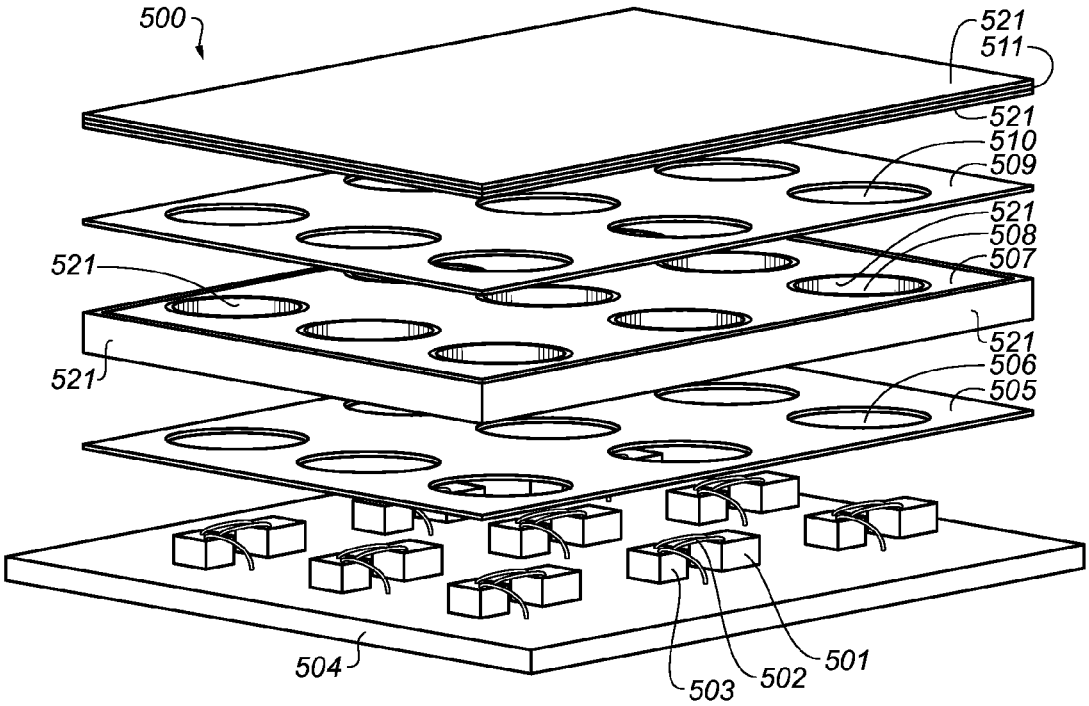
FIG. 5D is an isometric view of an alternative implementation of the embodiment of assembly of a plurality of acoustic devices illustrated in FIG. 5A.

FIG. 5D is an isometric view of an alternative implementation of the embodiment of assembly 500 of a plurality of acoustic modules illustrated in FIG. 5A. In this embodiment, the glass-reinforced epoxy or similar material layer 507 may be coated with an electromagnetic frequency (or "EMF") shielding coating 521 and/or the top layer 511 may be coated with an EMF shielding coating 520.

Alternatively, the top layer 511 and/or the glass-reinforced epoxy or similar material layer 507 may be formed of an EMF shielding material and not include such a coating 520 and/or 521. Additionally, in some embodiments, the glass-reinforced epoxy or similar material layer and/or the top layer may instead be covered with an EMF shield element.

Figure 6:
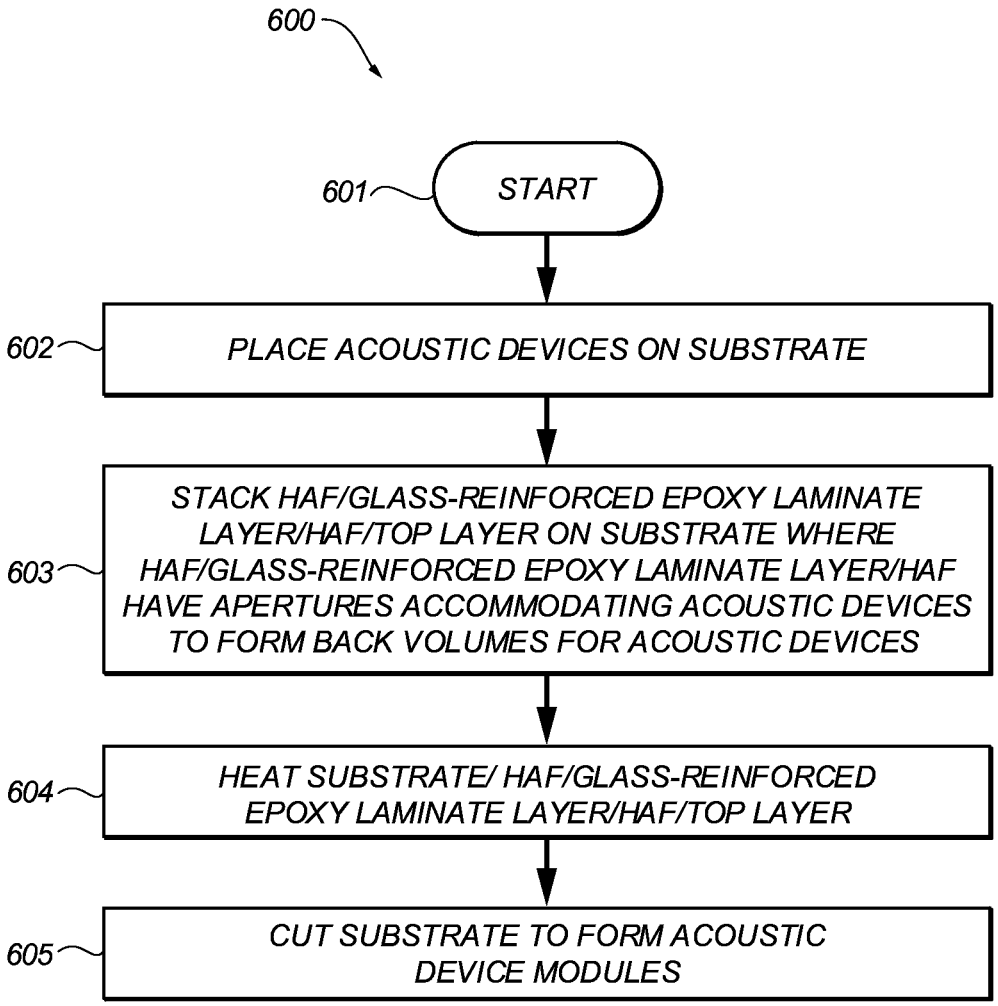
FIG. 6 is a method diagram illustrating a second example method for acoustic module manufacture. This method may involve operations and components similar to those illustrated in FIG. 5A-5C or 5D.

FIG. 6 is a method diagram illustrating a second example method 600 for acoustic module manufacture. This method may involve operations and components similar to those illustrated in FIG. 5A-5C or 5D.

The flow begins at block 601 and may then proceed to block 602 where a plurality of acoustic device components are placed on a substrate. The flow may then proceed to block 603 where a first layer of HAF, a glass-reinforced epoxy laminate or similar material layer, a second HAF layer, and a top layer are stacked on the substrate. The first layer of HAF, glass-reinforced epoxy laminate or similar material layer, and second HAF layer may each include apertures accommodating the acoustic device components and form back volume covers for acoustic devices that include the components.

Next, the flow may proceed to block 604 where the substrate, first layer of HAF, glass-reinforced epoxy laminate or similar material layer, the second layer of HAF, and the top layer are heated. Such heating may also include compressing these layers and may cause the first layer of HAF to adhere to the substrate and the glass-reinforced epoxy laminate or similar material layer and the second layer of HAF to adhere to the glass-reinforced epoxy laminate or similar material layer and the top layer.

Finally, the flow may proceed to block 605 where the substrate is cut to separate the acoustic devices into individual acoustic modules. Such cutting may include die cutting.

Although the method 600 is illustrated and described as including a particular set of operations performed in a particular order, it is understood that this is an example. In various implementations, various orders of the same, similar, and/or different operations may be performed without departing from the scope of the present disclosure.

For example, in some implementations the method 600 may also include adding EMF shielding, such as forming the glass-reinforced epoxy laminate or similar material layer and/or the top layer from an EMF shielding material and/or coating the glass-reinforced epoxy laminate or similar material layer and/or the top layer with an EMF shielding coating.

As described above and illustrated in the accompanying figures, the present disclosure details acoustic modules, such as speaker or microphone modules, and methods for manufacturing acoustic modules. In various embodiments, a plurality of acoustic modules that each include an acoustic port may be formed on a substrate. The substrate may be placed on a first layer of heat activated film (such as thermoplastic, thermoset, or other heat activated film) (HAF), a screen layer (such as a mesh, heat resistant acoustic mesh, or other screen element), and a second layer of HAF. The first and second layers of HAF may each have a plurality of apertures that are aligned with the acoustic ports of the acoustic devices. The substrate, layers of HAF, and the screen layer may be heated (which may also include compressing the layers) such that the first layer of HAF adheres to the substrate and the screen layer and the second layer of HAF adheres to the screen layer. The substrate may be cut to separate the plurality of acoustic devices into acoustic device modules.

In one or more embodiments, an acoustic module may include at least one acoustic port. A screen element may be bonded to a surface of the acoustic device to cover the acoustic port. A waterproof (i.e. waterproof and/or water resistant) membrane may be bonded to the at screen element. The waterproof membrane may be bonded to the screen element such that a gap is formed between the screen element and the waterproof membrane over the acoustic port such that the waterproof membrane is able to move through the gap under pressure until restrained by the screen element.

In one or more embodiments, a plurality of acoustic devices may be placed on a substrate. A first layer of HAF, at least one glass-reinforced epoxy laminate layer, a second layer of HAF, and a top layer may be stacked on the substrate. The first layer of HAF, glass-reinforced epoxy laminate layer, and second layer of HAF may each have a plurality of apertures that accommodate the plurality of acoustic devices such that the first layer of HAF, glass-reinforced epoxy laminate layer, second layer of HAF, and top layer form back volumes for the acoustic devices. The substrate, HAF layers, glass-reinforced epoxy laminate layer, and top layer may be heated such that the first layer of HAF adheres to the substrate and the glass-reinforced epoxy laminate layer and the second layer of HAF adheres to the glass-reinforced epoxy laminate layer and the top layer. The substrate may be cut to separate the plurality of acoustic devices into acoustic device modules.

In the present disclosure, the methods disclosed may be implemented as sets of instructions or software readable by a device. Further, it is understood that the specific order or hierarchy of steps in the methods disclosed are examples of sample approaches. In other embodiments, the specific order or hierarchy of steps in the method can be rearranged while remaining within the disclosed subject matter. The accompanying method claims present elements of the various steps in a sample order, and are not necessarily meant to be limited to the specific order or hierarchy presented.

The described disclosure may be provided as a computer program product, or software, that may include a non-transitory machine-readable medium having stored thereon instructions, which may be used to program a computer system (or other electronic devices) to perform a process according to the present disclosure. A non-transitory machine-readable medium includes any mechanism for storing information in a form (e.g., software, processing application) readable by a machine (e.g., a computer). The non-transitory machine-readable medium may take the form of, but is not limited to, a magnetic storage medium (e.g., floppy diskette, video cassette, and so on); optical storage medium (e.g., CD-ROM); magneto-optical storage medium; read only memory (ROM); random access memory (RAM); erasable programmable memory (e.g., EPROM and EEPROM); flash memory; and so on.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

While the present disclosure has been described with reference to various embodiments, it will be understood that these embodiments are illustrative and that the scope of the disclosure is not limited to them. Many variations, modifications, additions, and improvements are possible. More generally, embodiments in accordance with the present disclosure have been described in the context or particular embodiments. Functionality may be separated or combined in blocks differently in various embodiments of the disclosure or described with different terminology. These and other variations, modifications, additions, and improvements may fall within the scope of the disclosure as defined in the claims that follow.

We claim:

1. An acoustic module, comprising:

an acoustic device including an acoustic port;

a screen element bonded to a surface of the acoustic device to cover the acoustic port; and a waterproof membrane bonded to the screen element to cover the acoustic port;

wherein a portion of the waterproof membrane aligned with the acoustic port is separated from the screen element by a gap dimensioned to cause the screen element to restrain motion of the portion of the waterproof membrane when pressure sufficient to rupture the waterproof membrane is applied to the waterproof membrane.

2. The acoustic module of claim 1, wherein the screen element comprises at least one of a stiff material, stainless steel, a composite material, brass, or aluminum.

3. The acoustic module of claim 1, wherein the screen element includes a plurality of holes formed by at least one of chemical etching or laser perforation.

4. The acoustic module of claim 1, wherein the waterproof membrane comprises polytetrafluoroethylene.

5. The acoustic module of claim 1, wherein the waterproof membrane is permeable to air but impermeable to water.

6. The acoustic module of claim 1, further comprising:

a first layer of heat activated film bonding the screen element to the surface of the acoustic device; and a second layer of heat activated film bonding the waterproof membrane to the at least one screen element.

7. A portable electronic device, comprising:

a device housing including a first acoustic port;

an acoustic module coupled to the device housing, the acoustic module comprising:

a second acoustic port aligned with the first acoustic port and extending through a surface of the acoustic module, an acoustic component aligned with the second acoustic port;

a waterproof membrane covering the second acoustic port, a screen element covering the second acoustic port and positioned between the waterproof membrane and the acoustic component, and a spacer element disposed between the waterproof membrane and the screen element, the spacer element defining an opening aligned with the second acoustic port, the spacer element creating a gap between the waterproof membrane and screen element sized to allow the waterproof element to vibrate and pass acoustic waves through the first and second acoustic ports, wherein a thickness of the spacer element is selected to allow the screen element to restrain movement of the waterproof membrane in the area of the second acoustic port.

8. The portable electronic device of claim 7, wherein the spacer element comprises a bonding layer joining the waterproof membrane to the screen element.

9. The portable electronic device of claim 7, wherein the gap is sized to prevent tearing of the waterproof membrane when water pressure compresses a portion of the waterproof membrane in the area of the second acoustic port against the screen element.

10. An acoustic module, comprising:

an acoustic port extending through a surface of the acoustic module;

an acoustic component aligned with the acoustic port;

a waterproof membrane covering the acoustic port;

a screen element covering the acoustic port and positioned between the waterproof membrane and the acoustic component; and a spacer element disposed between the waterproof membrane and the screen element, the spacer element having an opening aligned with the acoustic port creating a gap between the waterproof membrane and screen element enabling the waterproof element to vibrate and pass acoustic waves through the acoustic port, wherein a thickness of the spacer element is selected to enable the screen element to restrain movement of the waterproof membrane in the area of the acoustic port.

11. The acoustic module of claim 10, wherein the spacer element is an adhesive layer bonding the waterproof membrane to the screen element.

* * * * *